US006509554B2

(12) United States Patent
Howard et al.

(10) Patent No.: US 6,509,554 B2
(45) Date of Patent: Jan. 21, 2003

(54) SUPPORT CLIPS AND INSULATORS FOR USE IN ELECTRIC HEATERS AND ELECTRIC HEATERS CONTAINING SAME

(75) Inventors: Keith Howard; James Sherrill, both of Cookeville; Ike Walker, Monterey, all of TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

(21) Appl. No.: 09/827,323

(22) Filed: Apr. 6, 2001

(65) Prior Publication Data

US 2002/0023918 A1 Feb. 28, 2002

Related U.S. Application Data

(60) Provisional application No. 60/226,876, filed on Aug. 23, 2000, and provisional application No. 60/234,236, filed on Sep. 21, 2000.

(51) Int. Cl.[7] ..... H05B 3/06
(52) U.S. Cl. ..... 219/536; 174/138 J
(58) Field of Search ..... 219/532, 536, 219/548, 478; 174/168, 138 J

(56) References Cited

U.S. PATENT DOCUMENTS 3,697,727 A * 10/1972 Neuman et al. ..... 219/532
4,458,141 A * 7/1984 Howard et al. ..... 219/532
4,531,017 A * 7/1985 Sherrill ..... 174/138 J
4,628,189 A * 12/1986 Danko ..... 219/532
4,656,340 A * 4/1987 St. Louis ..... 219/532
4,675,511 A * 6/1987 Sherrill ..... 219/532
4,994,654 A * 2/1991 St. louis ..... 219/532
5,124,534 A * 6/1992 Williams et al. ..... 219/532
5,925,273 A * 7/1999 Sherrill ..... 219/478
6,285,013 B1 * 9/2001 Holmes ..... 219/536

* cited by examiner

*Primary Examiner*—Teresa Walberg
*Assistant Examiner*—Leonid M Fastovsky
(74) *Attorney, Agent, or Firm*—Clark & Brody

(57) ABSTRACT

A clip for connecting one or two insulators to a rail (preferably a T-bar member) of an electric heater including at least one bendable metal clinching member, where the clip is securable to the rail by bending the clinching member around the rail. Preferably, the clinching member is one or two T-shaped end members disposed on transverse ends of the clip. Opposite end sections of the ridge of the T-shaped end member constitute clinching flaps which, in use, are clinched around a stem of a T-bar of an electric heater.

55 Claims, 5 Drawing Sheets

SUPPORT CLIPS AND INSULATORS FOR USE IN ELECTRIC HEATERS AND ELECTRIC HEATERS CONTAINING SAME

Priority of this application is based on U.S. Provisional Application No. 60/226,876, filed Aug. 23, 2000, and on U.S. Provisional No. 60/234,236, filed Sep. 21, 2000.

BACKGROUND OF THE INVENTION

The present invention relates to electric heaters. More particularly, this invention relates to clips and insulators for use in structures that support heating elements or coils in electric heaters, such as open coil heaters.

Open coil heaters typically include structures that support heating elements in a stacked or spaced parallel relationship with respect to other coils in the heater. The heating elements are operably connected to a terminal box assembly including control circuitry that selectively energizes the heating elements. Often, separate support structures are used to individually position each heating element within the heater. Alternatively, complex support structures have been designed that can support multiple coils within the heater.

Open coil heaters are known in the art. Reference is made, for example, to U.S. Pat. No. 4,144,445 (Thweatt, Jr.); U.S. Pat. No. 5,578,232 (Engelke); U.S. Pat. No. 5,093,558 (Blystone et al.); and U.S. Pat. No. 4,692,599 (Howard et al.). Open coil heaters typically include structures that support heating elements in a stacked or spaced parallel relationship with respect to other coils in the heater. The heating elements are operably connected to a terminal box assembly including control circuitry that selectively energizes the heating elements.

In the electric heater industry, the use of structural members or clips that partially encircle insulators and are, in turn, supported by being welded to frame bars is well known. An example is shown in U.S. Pat. No. 4,692,599 to Howard et al. ("the Howard patent"). One disadvantage to such a construction is the amount of welding required to attach each clip or support member to the frame bar, and that the welding is difficult to automate.

Other heater designs used in the industry reduce the amount of welding but at the expense of flexibility in design and at other costs. Reference is made, e.g., to U.S. Pat. No. 5,954,983 (Holmes) and U.S. Pat. No. 4,472,624 (Janning).

U.S. Pat. No. 5,954,983 to Holmes discloses an embodiment that eliminates welding of the member supporting the insulator onto the frame by making the frame and the clip from one piece of metal. One disadvantage to this design, however, is that once a particular number and spacing of clip members along a frame is chosen and produced, changing that configuration (such as by moving the clip members closer together) is difficult and costly.

U.S. Pat. No. 4,472,624 to Janning discloses an embodiment wherein insulators are held in the frame by placing them into roughly circular holes cut into cross beams, which in turn are welded on each end to a frame. Several insulator-supporting holes are cut into each cross beam. The welding is easier and less costly than that in the Howard patent because the welding in Janning is performed toward the outside of the frame, farther away from the insulators. There may also be fewer welds per insulator, depending on the number of insulators supported in each cross beam. On the other hand, changing the configuration (such as the spacing or number of insulators on each cross beam) in Janning is more difficult and costly than in the Howard patent, and significant scrap metal is produced from cutting or punching holes in the cross beams.

Accordingly, a primary object of this invention is to eliminate welding of clips onto the frame bar, while maintaining the flexibility of design permitted by the Howard patent.

A further object is to provide a procedure that, in addition to being more flexible than welding, is also cheaper and easier than welding.

Another object of this invention is to provide for a connection that is very strong.

These and other objects are achieved in the present invention.

SUMMARY OF THE INVENTION

One aspect of the present invention provides a clip for connecting one or two insulators to a rail of an electric heater frame. Broadly, the clip of this invention is composed of:

- a main body;
- means for securing at least one insulator to the main body, and
- at least one bendable metal clinching member extending from the main body, wherein the clip is securable to the rail by bending the clinching member around the rail.

A novel feature of this invention is that welding is not required to secure the clip to a rail. Specifically, the particular clinching member(s) present in the clip allows the clip to be secured to the rail without welding.

A second aspect of the present invention is directed to a rail/clip assembly composed of a rail and at least one clip of this invention secured to the rail. The rail preferably has a T-shaped cross-section and contains a ridge portion and a stem portion. The clip is secured to such T-shaped rail by bending the clinching member of the clip around the ridge portion of the rail.

A third aspect of the present invention is directed to an insulator which is intended to be secured to a rail via the clip of this invention. The insulator of this invention is composed of:

- upper and lower longitudinal sides, each longitudinal side having a central groove and two side notches formed therein, the central groove being disposed between the side notches;
- first and second transverse sides, each transverse side having an end groove formed therein; and
- front and back faces, each face having a transverse midsection disposed between the central grooves and being coaxial with a symmetrical transverse axis of the face; each face further having a longitudinal midsection disposed between the end grooves and being coaxial with a symmetrical longitudinal axis of the face.

A fourth embodiment of the present invention is directed to a rail/clip/insulator assembly, composed of a rail, the clip of this invention, and an insulator (preferably the insulator of this invention), wherein the insulator is secured to the rail via the clip. Specifically, the insulator is attached to the clip means for securing an insulator to the main body.

A fifth embodiment of the present invention is directed to an electric heater which uses clips within the scope of this invention to secure insulators to at least one rail of the heater. The heater of this invention is composed of:

- a terminal plate;
- a cross-beam;
- at least one rail, the rail being attached (preferably butt-welded) at one end to the terminal plate and attached at an opposite end to the cross-beam;
- at least one clip secured to the at least one rail, the clip containing:

a main body;

a means for securing an insulator to the main body, and at least one bendable metal clinching member extending from the main body, wherein the clinching member is bent around the rail so as to secure the clip to the rail; and an insulator attached to the means for securing an insulator to the main body.

A sixth embodiment of the present invention is directed to a method of securing an insulator to a rail, involving the steps of:

(1) providing a rail, an insulator and a clip, wherein the clip contains a main body, a means for securing an insulator to the main body, and at least one bendable metal clinching member extending from the main body, (2) securing the clip to the rail by bending the bendable clinching member around the rail; and (3) securing the insulator to the means for securing an insulator to the main body, wherein step (3) may be performed before or after step (2).

A seventh aspect of the present invention is directed to a method for making an electric heater, involving the steps of:

(1) providing a terminal plate, a cross-beam, at least one rail, at least one clip and at least one insulator, wherein the clip comprises a main body, a means for securing an insulator to said main body, and at least one bendable metal clinching member extending from the main body, (2) attaching a first end of the rail to the cross-beam and a second end of the rail to the terminal plate;

(3) securing the clip to the rail by bending said bendable clinching member around said rail; and (4) securing the insulator to the clip means for securing an insulator to the main body, wherein steps (2)–(4) may be performed in any order.

In the present invention, rather than welding clips onto the frame bar, clinch clips are used which are clinched or crimped onto a rail, preferably a T-shaped rail. No welding is required to attach the clips to the rail. The clinching procedure is easier, cheaper and more flexible than welding, and also provides a connection that is very strong.

DETAILED DESCRIPTION OF THE INVENTION

As stated above, the present invention is directed to improved clips for use in connecting insulators to rails, preferably T-shaped rails, in electric heaters, and to electric heaters using the clips of this invention. An important feature of this invention is that the clip is not welded to the rail. Instead, the clinching or crimping of the clip's flaps around the rail, e.g., around the ridge of the T-shaped rail, secures the clip to the rail.

While the invention is described with particular reference to open coil heaters, those skilled in the art will recognize the wider applicability of the inventive principles disclosed hereinafter. For example, this invention finds application in the heating and air conditioning field, and is useful in such devices as heat pumps, fan coil units, or combined heating and cooling air conditioners.

The clips and electric heater of this invention will be described with reference to the enclosed figures.

Figure 1:
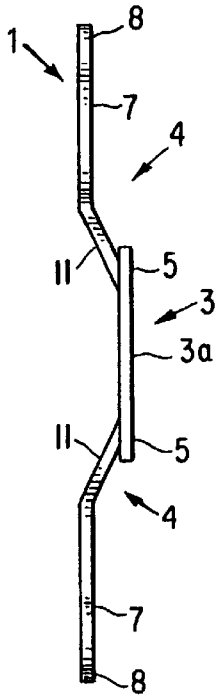
FIG. 1 is a top view of a first embodiment of a double clinch clip within the scope of the present invention.
Figure 2:
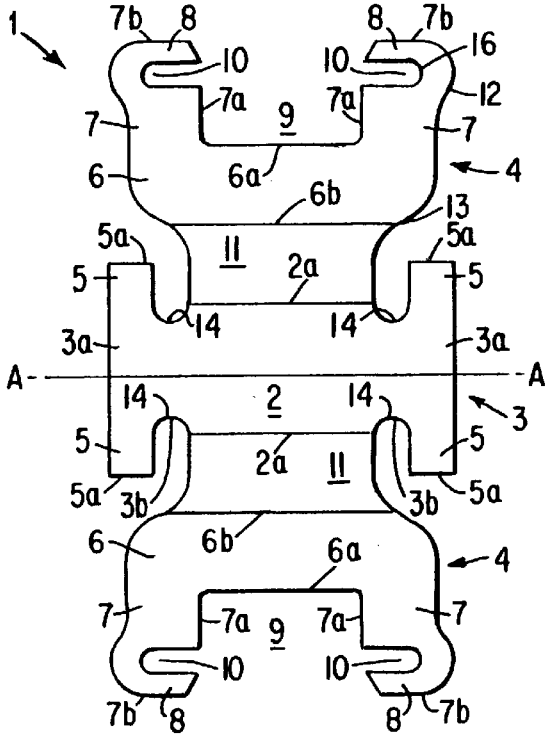
FIG. 2 is a front view of the double clinch clip shown in FIG. 1.

FIGS. 1 and 2 respectively illustrate top and front views of a first embodiment of the clinch clip of this invention, wherein the clip is designed to support two insulators (not shown). The clip is referred to herein as a "double clinch clip", and is generally referred to in the accompanying figures by reference numeral 1.

Clip 1 (also referred to herein as "double clip 1") includes a main body 2, at least one bendable metal clinching member 3 extending from main body 2, and a means 4 for securing an insulator (not shown in FIGS. 1 and 2) to the main body.

Preferably, main body 2 is a flat, elongated, rectangular structure.

Bendable metal clinching member 3 is preferably a T-shaped structure formed on opposite transverse edges of main body 2. The T-shaped structure has a ridge 3*a* and a stem 3*b*, stem 3*b* being disposed between main body 2 and ridge 3*a* and being coaxial with a longitudinal axis A—A of the main body. The end sections of ridge 3*a* constitute clinching flaps 5 which, when the clip is attached to a rail, will be clinched or crimped around the rail. When the rail is a T-bar, flaps 5 will be clinched or crimped around the ridge portion of the T-bar (see, e.g., FIGS. 14 and 15).

Stems 3*b* of the T-shaped structure are preferably concave in shape, as shown in FIG. 2.

As shown in the attached figures, clip 1 preferably has two bendable metal clinching members 3.

In clip 1, the length (i.e., the distance between the ends 5*a* of flaps 5) of ridge 3*a* is greater than the width (i.e., the distance between longitudinal sides 2*a* ) of main body 2.

In clip 1, the means 4 for securing an insulator to the main body is preferably in the form of a single side member extending from a longitudinal side 2*a* of main body 2 or two side members extending from opposite longitudinal sides 2*a* of the main body. Each side member 4 is used to secure an insulator to clip 1. Thus, if the clip has two side members, the clip will be able to secure two insulators to the rail. If the clip has a single side member, the clip will be able to secure one insulator to the rail.

In one preferred embodiment, side member 4 is composed of a base section 6, two arms 7 extending from opposite ends of base section 6, and one or more (preferably two) bendable tabs 8 formed at the free ends of arms 7.

Base section 6 has an upper edge 6*a* and a lower edge 6*b*. Each of the arms 7 has an inner wall edge 7*a* and an outer wall edge 7*b*. Upper edges 6*a* and 6*b* of base section 6 are preferably parallel to one another and also preferably parallel to longitudinal axis A—A of main body 2. Inner wall edges 7*a* of arms 7 are preferably parallel to one another and perpendicular to upper edge 6*a* of base section 6.

Figure 14:
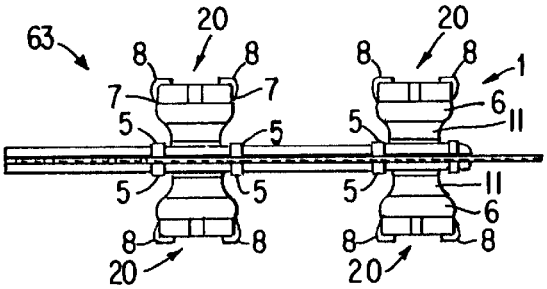
FIG. 14 is a side view of the T-bar/clip/insulator assembly shown in FIG. 13.

Upper edge 6*a* and inner wall edges 7*a* define a cavity 9 (preferably U-shaped), which is disposed to receive therethrough an insulator (not shown in FIGS. 1 and 2), e.g., as shown in FIG. 14. Upper edge 6*a* (which constitutes the bottom edge of cavity 9), inner wall edges 7*a* and tabs 8 are each disposed to secure the insulator in cavity 9. Tabs 8 are bent after the insulator is inserted into cavity 9.

Upper edge 6*a* is flat so as to form an abutting face with the transverse midsection (see, e.g., FIG. 14) of a front or back face of an insulator when such insulator is installed on the clip.

Inner edges 7*a* of arms 7 preferably have formed therein two opposite notches 10, which are preferably elongated and U-shaped, as shown in FIG. 2. Defined between notch 10 and top edge 7*b* of each arm 7 is tab 8.

Preferably, each side member 4 further contains a neck section 11 disposed between longitudinal edge 2*a* of main body 2 and lower edge 6*b* of base section 6. For reasons discussed below, neck 11 is preferably disposed at an angle relative to main body 2.

Flaps 5 of clip 1 are adapted to secure the clip to a rail, preferably a T-bar, of a heater frame while side members 4 are adapted to secure insulators (and, consequently, heating coil sections supported by the insulators) to the clip, thereby securing the insulators to the rail. Neck sections 11, if angled appropriately relative to main body 2 and base section 6, will allow the rail (preferably the stem section of a T-bar) to be disposed an equal distance between the heating coil sections supported by the insulators connected to the clip.

Clip 1 is shaped to minimize resistance to airflow perpendicular to the wide side of the clip surface, as shown in FIG. 2, without sacrificing the strength of the clip. Specifically, the roughly hour-glass shaped outline of the clip has several inward curvatures 12, 13, 14 and 15, which permit passage of airflow.

Figure 3:
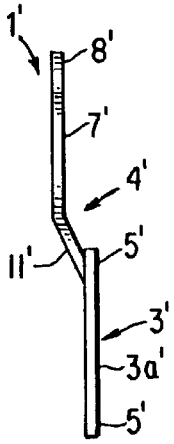
FIG. 3 is a top view of a first embodiment of a single clinch clip within the scope of the present invention.
Figure 4:
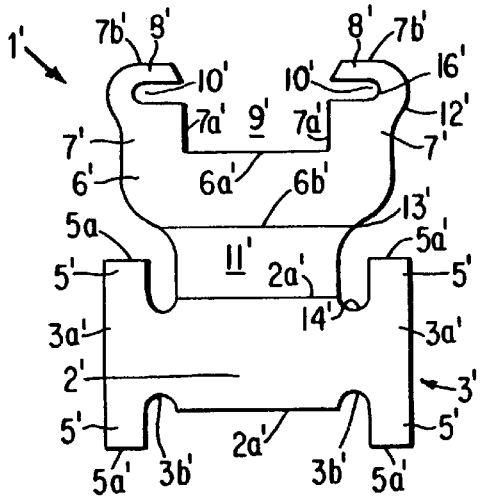
FIG. 4 is a front view of the single clinch clip shown in FIG. 3.

FIGS. 3 and 4 illustrate a second embodiment of the clinch clip used in this invention, wherein the clip is designed to support a single insulator (not shown), i.e., a "single" clinch clip 1'.

Clip 1' is similar in every respect to clip 1 except that clip 1' is adapted to secure only one insulator. Thus, features designated by reference numerals 2'–15' in clip 1' correspond to features designated by reference numerals 2–15 in clip 1 and will not be discussed herein.

In other embodiments of the clip of this invention, the means for securing the insulator to the rail may differ from side members 4 shown in FIGS. 1–4. For example, FIGS. 5 and 6 respectively illustrate side views of two additional embodiments of a double clinch clip for use in the present invention These double clips, referred to generally by reference numerals 100 and 200, respectively, differ from double clip 1 primarily in the main bodies, T-shaped, flap-containing portions and the insulator-receiving portions thereof. As will be seen, clips 100 and 200 also differ from one another in their main bodies and the number of clinching flaps.

Figure 5:
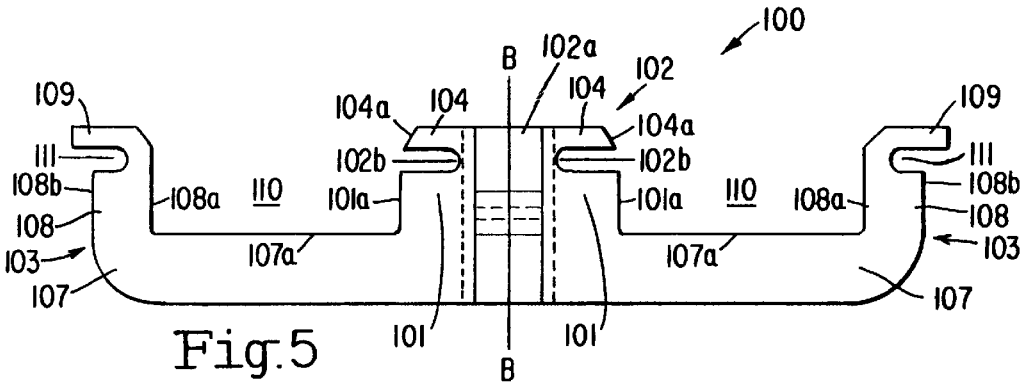
FIG. 5 is a side view of a second embodiment of a double clinch clip within the scope of the present invention.

As shown in FIG. 5, clinch clip 100 includes a flat, rectangular and elongated main body 101, a single clinching member (preferably in the form of T-shaped member 102 extending from a transverse side of main body 101), and two side members 103 extending from longitudinal sides 101*a* of main body 101.

T-shaped member 102 is composed of a ridge 102*a* and a stem 102*b*, the stem 102*b* being disposed between ridge 102*a* and main body 101 and being coaxial with a longitudinal axis B—B of main body 101. The ends of ridge 102*a* constitute clinching flaps 104 which, when used, are crimped or clinched around a rail (preferably, a ridge section of a T-bar) to secure the clip to the rail.

Preferably, as shown in FIG. 5, stem 102*b*of T-shaped member 102 is concave-shaped. Also preferably, the ends 104*a* of flaps 104 are slanted outwardly from the upper and lower edges of ridge 102.

Side members 103 each have a base section 107, an arm 108 extending from one end of base section 107, and a bendable tab 109 formed at a free end of arm 108. Base section 107 has an upper edge 107*a*, and arm 108 has an inner wall edge 108*a* and an outer wall edge 108*b*. Upper edge 107*a* is perpendicular to longitudinal axis B—B of main body 101 and to inner and outer wall edges 108*a*, 108*b* of arm 108.

Upper edge 107*a* of base section 7, longitudinal side 101*a* of main body 101 and inner wall edge 108*a* of arm 108 define a central cavity 110, which is disposed to receive therethrough an insulator (not shown).

Preferably, each outer wall edge 108*b* of arm 108 has formed therein a notch 111 which defines tab 109 above it.

An insulator is secured within cavity 110 by means of upper edge 107*a*, longitudinal side 101*a*, inner wall edge 108*a* and tab 109. After the insulator is inserted into the cavity, tab 109 is bent over the insulator.

Figure 6:
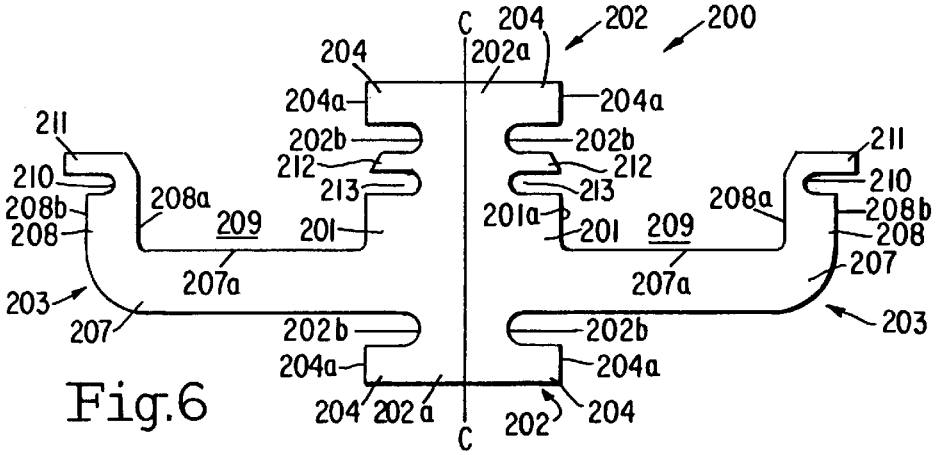
FIG. 6 is a side view of a third embodiment of a double clinch clip within the scope of the invention.

In FIG. 6, clinch clip 200 includes a flat, elongated main body 201, two T-shaped members 202 extending from opposite transverse sides of main body 201, and two side members 203 extending from longitudinal sides 201*a* of main body 201.

Each T-shaped member 202 is composed of a ridge 202*a* and a stem 202*b*, the stem 202*b* being disposed between ridge 202*a* and main body 201 and being coaxial with a longitudinal axis CC of main body 201. The ends of ridge 202*a* constitute clinching flaps 204 which, when used, are crimped or clinched around a rail, preferably the ridge section of a T-bar, to secure the clip to the rail. Stem 202*b* is preferably concave-shaped. Also preferably, the ends 204*a* of flaps 204 extend vertically between the upper and lower edges of ridge 202.

Preferably, as shown in FIG. 6, stem 202*b* of T-shaped member 202 is concave-shaped. Also preferably, the ends 204*a* of flaps 204 are slanted vertically from the upper and lower edges of ridge 202.

Side members 203 each have a base section 207 and an arm 208 extending from one end of base section 207. A central, insulator-receiving cavity 209 is defined between longitudinal side 201*a* of main body 201, upper edge 207*a* of base section 207 and inner side edge 208*a* of arm 208. Edge 207*a* is perpendicular to longitudinal axis C—C of main body 201.

The outer wall edge 208*b* of each arm 208 preferably has formed at an upper end thereof a notch 210. Defined above each notch 210 is a bending tab 211.

The main body 201 of clip 200 has formed in opposite longitudinal sides 201*a* thereof a pair of additional bending tabs 212, preferably defined between notches 213 formed in longitudinal sides 201*a* and the notches defining stem 202*b* of T-shaped member 202, to be used in conjunction with bending tab 211 in securing an insulator in cavity 209.

Figure 7A:
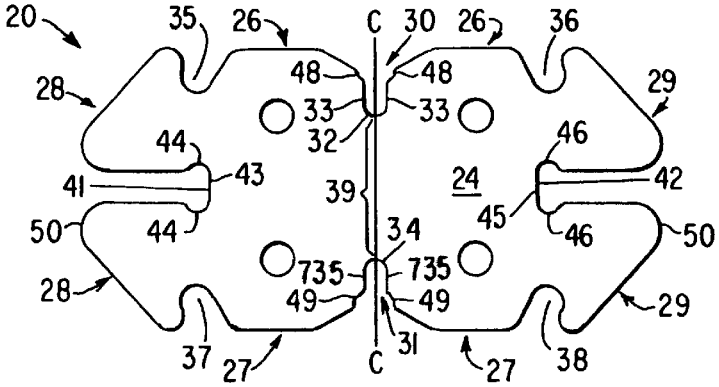
FIG. 7A is a front facial view of a first embodiment of a ceramic insulator which can be used in conjunction with the clips shown in FIGS. 1–4.
Figure 7B:
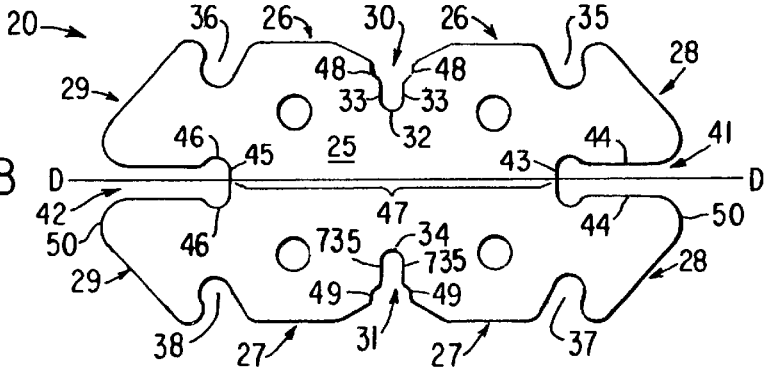
FIG. 7B is a back facial view of the ceramic insulator shown in FIG. 7A.
Figure 8:
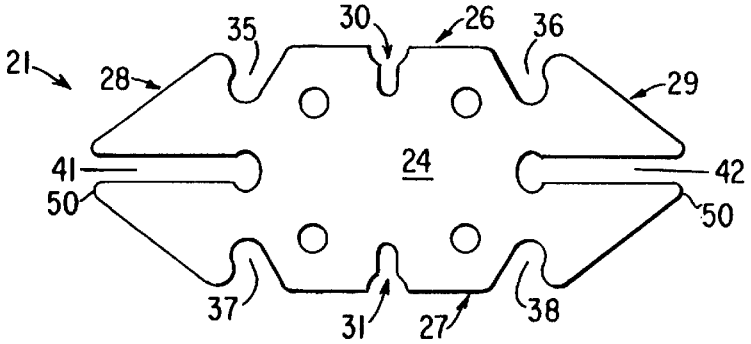
FIG. 8 is a front facial view of a second embodiment of a ceramic insulator which can be used in conjunction with the clips shown in FIGS. 1–4.
Figure 9:
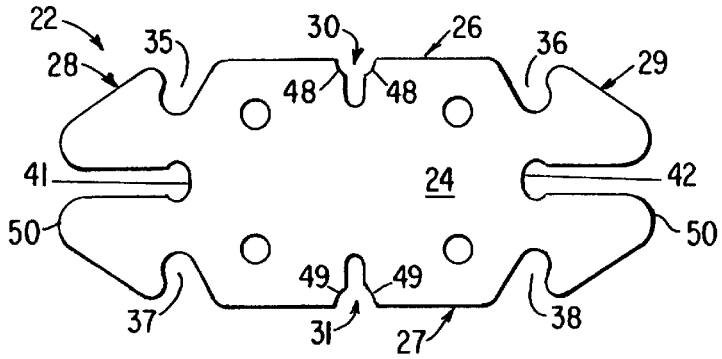
FIG. 9 is a front facial view of a third embodiment of a ceramic insulator which can be used in conjunction with the clips shown in FIGS. 1–4.
Figure 10:
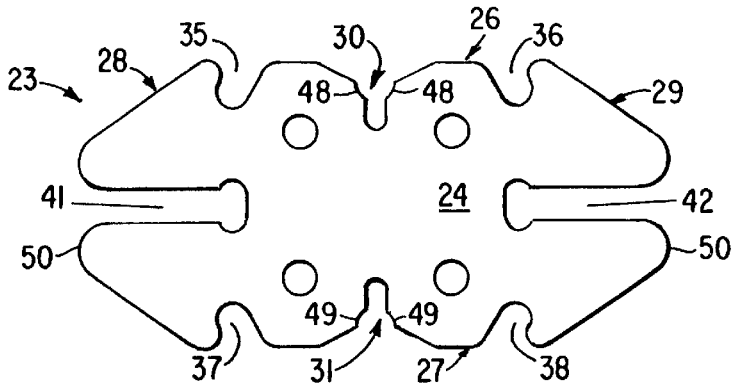
FIG. 10 is a front view of a fourth embodiment of a ceramic insulator which can be used in conjunction with the clips shown in FIGS. 1–4.
Figure 11:
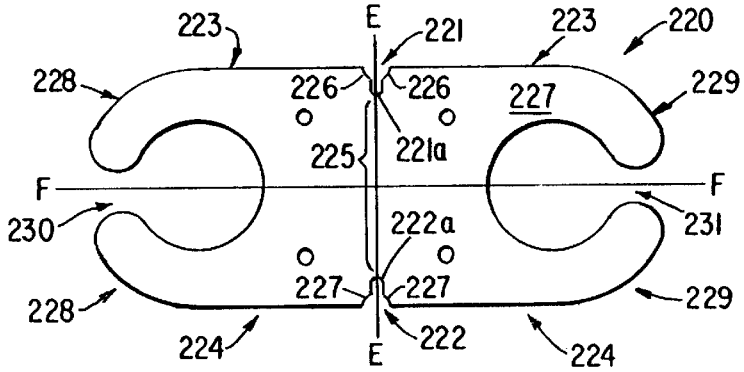
FIG. 11 is a front view of an insulator which can be used with the clip shown in FIG. 6.
Figure 12:
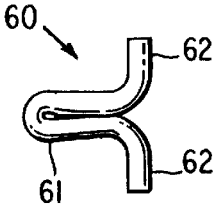
FIG. 12 is a top view of a T-bar which can be used in the electric heaters of this invention.

FIGS. 7A and 8–10 illustrate front facial views of four ceramic insulators 20, 21, 22 and 23, respectively, of varying structures which can be used in conjunction with clips 1 and 1'. FIG. 7B illustrates a back facial view of insulator 20. FIGS. 11 and 12 illustrate front and side views, respectively, of an embodiment of an insulator which can be used in conjunction with clips 100 and 200.

The insulators used in the present invention are preferably "point suspension type" insulators, which have notches or slots which grip a heater coil at a point, rather than requiring the heater coil to be entirely inserted through the central opening of a bushing type insulator.

The insulators used in the present invention have a novel design wherein the same insulator can be used with clips of varying cross-sectional shapes. For example, the insulators shown in FIGS. 7–10 will accommodate clinch clips having circular or rectangular cross-sectional shapes (which are the two most common cross-sectional shapes for clips used in the industry) or other cross-sectional shapes.

Insulators 20–23 each have a front face 24 and a back face 25 (see FIG. 7B) preferably identical to the front face. Extending between faces 24 and 25 are upper longitudinal side 26, lower longitudinal side 27, first transverse side 28 and second transverse side 29. The longitudinal sides are preferably identical to one another, as are the transverse sides.

Formed respectively on longitudinal sides 26 and 27 are identical central grooves 30 and 31, both of which extend from one face of the insulator to the other face. Specifically, groove 30 has a bottom edge or floor 32 and side walls 33, and groove 31 has a bottom edge or floor 34 and side walls 735. Preferably, bottom edges 32 and 34 are parallel to one another.

Each longitudinal side of insulators 20–23 further has formed therein a pair of side notches. Specifically, longitudinal side 26 has first and second side notches 35 and 36, and longitudinal side 27 has third and fourth side notches 37 and 38 formed therein. Side notches 35 and 36 are disposed on opposite sides of central groove 30, while side notches 37 and 38 are dispose on opposite sides of central groove 31. In addition, side notches 35 and 37 are preferably disposed opposite from one another on opposite longitudinal sides 26 and 27, and side notches 36 and 38 are preferably located opposite from one another on the opposite longitudinal sides. Notches 35–38 are preferably identical to one another.

The front face 24 of each of insulators 20–23 has a transverse midsection 39 which extends between grooves 30 and 31 and which is coaxial with a symmetrical transverse axis C—C of the front face. Back face 25 of each insulator also has a transverse midsection (not shown) which extends between grooves 30 and 31 and which is coaxial with a symmetrical transverse axis of the back face (see FIG. 7A).

Formed on transverse sides 28 and 29 of the insulator are respective first and second end grooves 41 and 42, both of which extend from one face of the insulator to the other face. Specifically, groove 41 has a bottom edge or floor 43 and side walls 44, and groove 42 has a bottom edge or floor 45 and side walls 46. Preferably, bottom edges 43 and 45 are parallel to one another.

The front face 24 of the insulator has a longitudinal midsection (not shown) which extends between grooves 41 and 42 and which is coaxial with a symmetrical longitudinal axis of the front face. Back face 25 of the insulator also has a longitudinal midsection 47 (see FIG. 7B) which extends between grooves 41 and 42 and which is coaxial with a symmetrical longitudinal axis D—D of the back face.

When one of insulators 20–23 is attached to clip 1, the insulator is situated in cavity 9 of side member 4 such that transverse midsection 39 of the insulator abuts bottom edge 7*a* of cavity 9 in parallel fashion, arms 7 of side member 4 are disposed within central grooves 30 and 31 of the insulator, and bending tabs 8 are disposed over the transverse midsection of the back face of the insulator. Preferably, when the insulator is secured to the clip, inner wall edges 7*a* of arms 7 are parallel to the floors 32 and 34 of respective central grooves 30 and 31. After the insulator is inserted into cavity 9, tabs 8 are bent over the transverse midsection of the back face 25 to help secure the insulator in the cavity.

Grooves 30 and 31 allow the insulators to accommodate more than one cross-sectional shape of support clip. The relatively narrow grooves 30 and 31 allow the insulator to accommodate flat, rectangular clips. Floors 32 and 34 (which constitute the extreme end portions of grooves 30 and 31) are preferably U-shaped, even though the end of the clip is squared off, because the clip does not extend all the way into the grooves, leaving some extra space to accommodate the expansion of metal when it is heated. At the opening of groove 30 are two semi-circular portions 48 on either side of groove 30, and at the opening of groove 31 on either side thereof are two semi-circular portions 49. Semi-circular portions 48 and 49 allow respective grooves 30 and 31 to accommodate a clip surface that has a circular cross-section. In this way, the same insulator can be used for different products.

Side notches 35–38 and end grooves 41 and 42 are sized and arranged to freely pass and receive a convolution section (not shown) of a heating coil element. The width of each of notches 35–38 and grooves 41 and 42 is somewhat wider than the thickness of the electrical resistance heating wire of the heating coil section attached to the insulator.

Another feature of the insulators used in the present invention is that they are of uniform length. The length is shown in FIGS. 7–10 as the distance between the insulator tip 50 on one end to the insulator tip 50 on the other end. This system of uniform length accommodates automatic loading of the ceramic insulators into the clinch clips. More particularly, an automatic loading mechanism has to be changed every time a different length insulator is used. Nonetheless, the insulators do not sacrifice flexibility in the spacing of heating coils, because the distance between the insulator notches that secure the coils is variable, and it is that distance that defines the separation of the heating coil from the center of the ceramic. In other words, because the length of end grooves 41 and 42 in FIG. 7A is shorter than the length of end grooves 41 and 42 in FIG. 10, the coils will be farther from the center of the insulator in FIG. 7A than in FIG. 10.

FIG. 11 illustrates a front view of an embodiment of an insulator which can be used in conjunction with clips 100 and 200 shown in FIGS. 5 and 6, respectively.

In FIG. 11, insulator 220 , like insulators 20–23, has a front face 227 and an identical back face (not shown) and contains two central grooves 221 and 222 formed in opposite upper and lower longitudinal sides 223 and 224, respectively. The portion of the front face of the insulator between grooves 221 and 222 constitutes the transverse midsection 225 of the front face of the insulator. Transverse midsection 225 is coaxial with a symmetrical transverse axis E—E of the front face. When the insulator is attached to clip 100 or clip 200, midsection 225 is inserted into cavity 110 or 209 such that midsection 225 abuts bottom edge 107*a* or 207*a*. Midsection 225 and transverse axis E—E will be parallel to bottom edge 107*a* or 207*a*.

Like grooves 30 and 31 in insulators 20–23, grooves 221 and 222 allow the insulator to accommodate more than one cross-sectional shape of support clip. The extreme end portions 221*a* and 222*a* of the grooves are U-shaped. At the opening of groove 221 are two semi-circular portions 226 on either side of the groove, and, likewise, two semi-circular portions 227 are formed at the opening of groove 222 on either side of the groove. Semi-circular portions 226 and 227 together can accommodate a clip surface that has a circular cross-section. In this way, the same insulator can be used for different products.

Grooves 221 and 222 are generally coaxial with symmetrical transverse axis E—E of the front face of the insulator and with a symmetrical transverse axis of the back face (not shown) of the insulator, and are spaced from one another.

Insulator 220 has two transverse sides 228 and 229 and end grooves 230 and 231 formed in sides 228 and 229, respectively. End grooves 230 and 231 are both coaxial with a symmetrical longitudinal axis F—F of the front face and with a symmetrical longitudinal axis of the back face of the insulator. End grooves 230 and 231 are spaced apart from one another.

The insulators used in the present invention are preferably made of a ceramic-like material, e.g., steatite, so as to electrically insulate the heating coil from the heater frame and also to thermally insulate the heating coil and prevent undue conduction of heat away from the portions of the heating coil in contact with the insulator.

FIG. 12 illustrates a cross-section of a T-bar 60 which can be used as the rail in the heater of this invention. Because of its "T" shape, the T-bar used in the present invention will be very strong and will not deflect as a result of heating and cooling or as a result of normal mechanical forces, unlike bars used in the prior art. The T-bar is made separately from narrow, flat pieces of metal, without cross-beams or clips, which are attached subsequently. Consequently, there is little scrap material in making the T-bar, which can be made using automation.

As shown in FIG. 12, the cross-section of T-bar 60 is composed of a stem portion 61 and a ridge portion 62. When clip 1 or clip 1' is attached to T-bar 60, clinching flaps 5 of clip 1 or clinching flaps 5' of clip 1' are crimped or clinched around ridge portion 62. The clinch clips and the T-bar are preferably oriented so that burrs (not shown), which are always present on cut edges of metal, oppose each other when the clip is clinched to the bar. These interlocking burrs add friction, thus increasing the mechanical strength of the connection.

Figure 13:
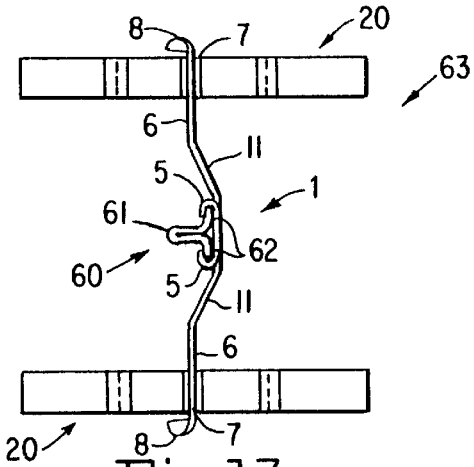
FIG. 13 is a top view of a first embodiment of a T-bar/clip/insulator assembly within the scope of this invention.

FIGS. 13 and 14 illustrate top and side views, respectively, of a first embodiment 63 of a T-bar/clip/insulator assembly of this invention, wherein double clip 1 is used to secure two insulators 20 to T-bar 60. In assembly 63, two insulators 20 (see FIG. 7A) are secured between arms 7 and tabs 8 of side member 4 of clip 1. Flaps 5 of clip 1 are clinched around ridge portion 62 of T-bar 60 so as to hold ridge portion 62 flush against a face (not shown) of main body 2 of the clip. Neck sections 12 are angled between main body 2 and base section 6 of clip 1 so that stem portion 61 of T-bar 60 will be oriented at equal distances between adjacent insulators 20 and, hence, at equal distances between adjacent heating coil runs (not shown) supported by insulators 20.

Figure 15:
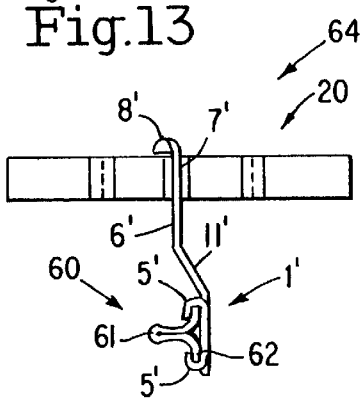
FIG. 15 is a top view of a second embodiment of a T-bar/clip/insulator assembly within the scope of this invention.
Figure 16:
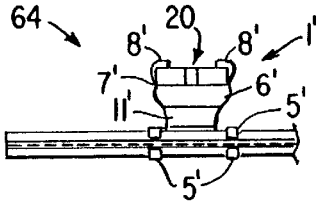
FIG. 16 is a side view of the T-bar/clip/insulator assembly shown in FIG. 15.

FIGS. 15 and 16 illustrate top and side views, respectively, of a second embodiment 64 of a T-bar/clip/insulator assembly of this invention, wherein single clip 1' is used to secure a single insulator 20 to a T-bar 60.

Figure 17:
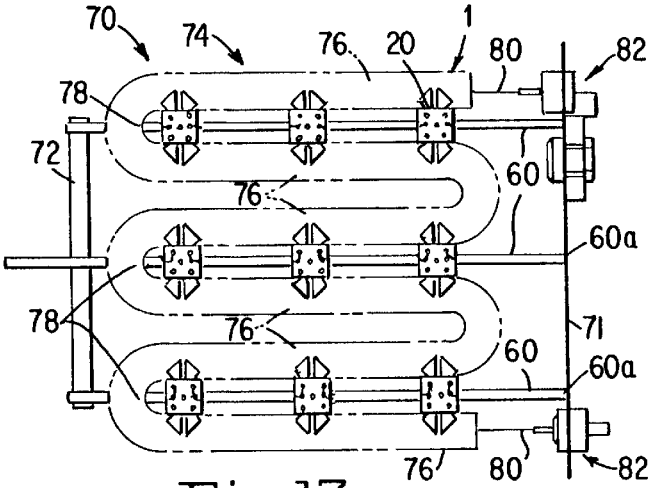
FIG. 17 is a top view of a first embodiment of an electric heater within the scope of this invention.
Figure 18:
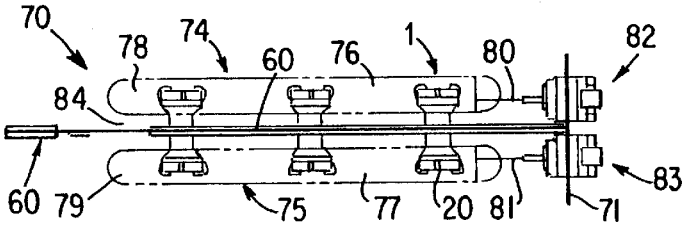
FIG. 18 is a side view of the electric heater shown in FIG. 17.

FIGS. 17 and 18 illustrate front and side views, respectively, of a first embodiment 70 of an electric heater of this invention.

Heater 70 contains a terminal plate 71, a top cross-beam 72, three T-bars 60 attached to terminal plate 71 and beam 72, two heating elements 74 and 75 disposed on opposite sides of T-bars 60, double clinch clips 1 attached to T-bars 60 (three clips per T-bar), and two insulators 20 attached to each clip 1.

T-bars 60 are attached at one end to terminal plate 71 and on the opposite end to cross beam 72.

Heating elements 74 and 75 are each a continuous length of suitable electrical resistance heating wire, such as Nichrome or the like. Preferably, the heating elements are in the form of longitudinal helical coils of the electrical resistance heating wire with the coils each having a multiplicity of generally uniformly spaced convolutions.

Heating elements 74 and 75 each have a plurality (e.g., six in FIGS. 17 and 18) of heating element runs 76 and 77, respectively. Each of the adjacent runs of the heating elements are electrically connected in series to an adjacent run of the heating element by a looped end turn. For heating element 74, these looped end turns are referenced as numeral 78, and for heating element 75, the looped end turns are referenced as numeral 79.

In addition to the runs and looped end turns discussed above, heating elements 74 and 75 each have leads 80 and 81, respectively, which constitute the ends of the heating elements and which are electrically connected to respective electric terminals 82 and 83 in terminal plate 71. Those skilled in the art will recognize that terminals 82 and 83 may be connected to a source of electrical power (not shown) for energizing heating elements 74 and 75 in the conventional manner.

As shown in FIGS. 17 and 18, heating elements 74 and 75, via heating element runs 76 and 77, respectively, are supported on insulators 20, thereby holding heating elements 74 and 75 clear of T-bars 60 and supporting the heating elements during energization. Specifically, in each clip 1, insulator 20 is secured in a central cavity 9 between arms 8 and tabs 9. As can be seen in FIG. 18, the longitudinal axis of each insulator 20 is perpendicular to T-bar 60.

As can be seen in FIG. 18, a particular feature of T-bars 60 is that ridge portions 62 are trimmed off on the section of the T-bar just after the topmost clip 1, creating a flat surface 84. Flat surface 84 offers two advantages. First, it provides a convenient surface for welding cross-beams, e.g., cross-beam 72, to multiple T-bars in a frame, to hold them together. Second, flat surface 84 is positioned underneath the unsupported, bending portion (e.g., looped end turns 78 and 79) of the heating elements. The looped end turns of the heating elements are the most likely portion of the coil to sag. Thus, the presence of flat surface 84 in the T-bar creates maximum electrical clearance between the metal T-bar and the least supported portion of the heating element.

Figure 19:
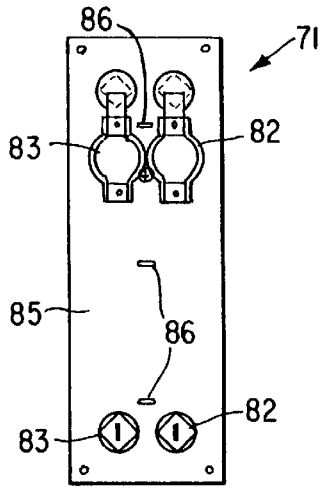
FIG. 19 is a bottom facial view of a terminal plate which can be used in the electric heater shown in FIGS. 17 and 18.

FIG. 19 shows a bottom face 85 of terminal plate 71 used in heater 70.

Attached to terminal plate 71 are two electrical plugs 82 for terminal end pins 80 of heating element 74 and two electrical plugs 83 for terminal end pins 81 of heating element 75.

One end 60*a* of each of T-bars 60 is preferably butt-welded directly to terminal plate 71. Using butt-welding to attach T-bars to a terminal plate in electric heaters is another novel feature of this invention. In the prior art, frame bars were bent or otherwise shaped to increase the surface area to be welded onto the terminal plate. Butt-welding decreases the amount of terminal plate surface area taken up by welding the frame bars to the terminal plate, and allows for automation.

Welding is difficult in the heating element industry because the metal in frames is coated with anti-corrosion materials. The coating, with its oxide layer, must be blown away by the welding process before a secure joint can be formed. In the prior art, both the frame and the terminal plate were corrosion-protected, causing welding to be difficult and hard to control. In the present invention, the end 60*a* of each T-bar 60 is severed, providing a fresh, uncoated surface that can be welded onto terminal plate 71. Consequently, the welding process is simpler, as only one barrier, namely the coating on the terminal plate, has to be overcome to create a secure weld. In addition, the T-bars 60 can be shorter with butt-welding, saving metal and labor, as special end shapes are eliminated. Further, embossments 86 (shown in FIG. 19) can be formed in bottom face 85 of terminal plate 71 to improve the strength of the welds.

Terminal plate 71 is preferably constructed from 18 gauge galvanized steel.

Figure 20:
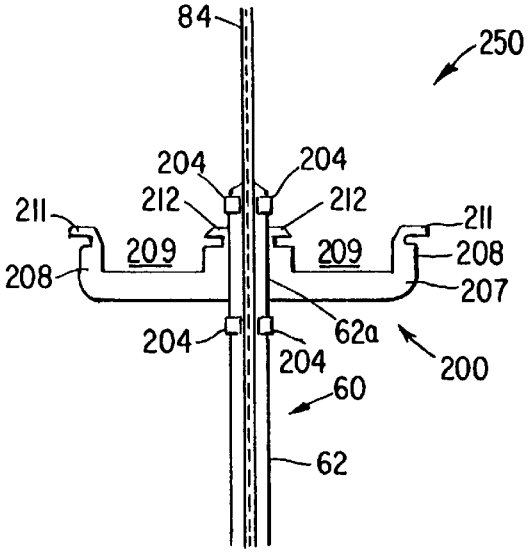
FIG. 20 is a side view of an embodiment of a T-bar/clip assembly of this invention, wherein the clip shown in FIG. 6 is attached to the T-bar shown in FIG. 12.

FIG. 20 illustrates a side view of a T-bar/clip assembly 250 within the scope of the present invention, wherein clip 200 is attached to T-bar 60.

As shown in FIG. 20, clinching flaps 204 of clip 200 are clinched around the ridge portion 62 of T-bar 60. Base sections 207 of the clip extend at right angles relative to T-bar 60.

Figure 21:
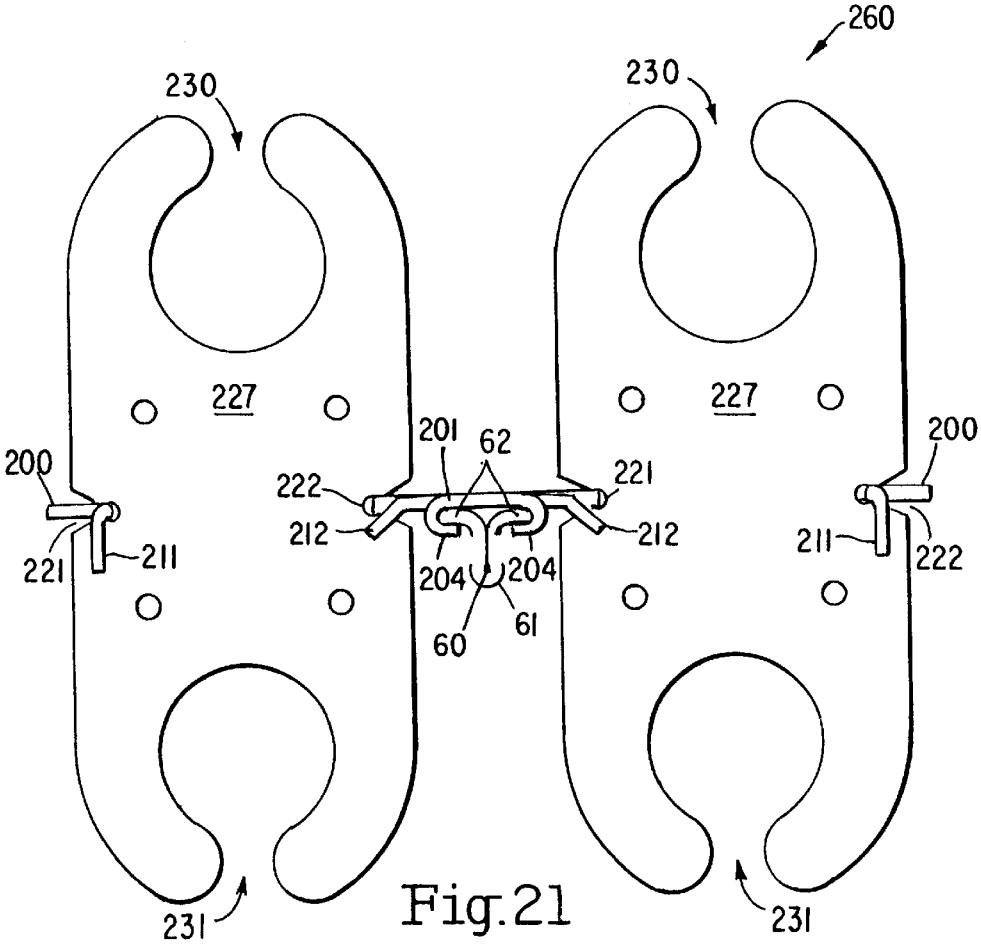
FIG. 21 is a top view of an embodiment of a T-bar/clip/insulator assembly of this invention, wherein the clip shown in FIG. 6 is attached to the T-bar shown in FIG. 12 and the insulator shown in FIG. 11.

FIG. 21 illustrate a top view of a T-bar/clip/insulator assembly 260 of this invention, wherein clip 200 is used to attach insulators 220 to T-bar 60.

As shown in FIG. 21, clinching flaps 204 are clinched around ridge portion 62 of T-bar 60. Transverse midsection 225 of insulator 220 is inserted into cavity 209 such that arm 208 fits within groove 221 and tabs 211 and 212 are disposed over insulator facial surface (e.g., front facial surface 227) When installed in this manner, the facial surface (e.g., front facial surface 227) of insulator 220 will be disposed perpendicularly relative to T-bar 60.

The clinching process used to secure the clinching flaps of the clip of this invention to a ridge portion of a T-bar can be automated and completed faster than the welding of clips onto frame bars. After the clip is clinched onto the T-bar, the security of the connection can be monitored by measuring the height of the crimp joint. Such height readings can be used as parameters for statistical process control methods. In contrast, the security of a welded connection between a clip and a frame bar can only be checked by wasteful, destructive tests, which are at best only spot checks. Additionally, broken clinch chips can easily be removed and replaced. Moreover, the clinching process provides the same kind of design flexibility as heaters with clips welded to frames, in contrast to one-piece frame and clip assemblies, in that no new tooling is required to change configurations of clips along the frame bar, such as by changing the distance between clips.

What is claimed is:

1. A clip for connecting an insulator to a rail of a frame of an electric heater, comprising:

a main body;

a means for securing an insulator to said main body; and at least one bendable metal clinching member extending from the main body, wherein said clip is securable to said rail by bending said bendable clinching member around said rail.

2. A clip according to claim 1, wherein the main body is a flat, elongated and rectangular structure.

3. A clip according to claim 2, wherein the clip comprises two of the at least one bendable metal clinching member.

4. A clip according to claim 3, wherein the bendable metal clinching members extend from opposite transverse edges of the main body.

5. A clip according to claim 4, wherein each bendable metal clinching member has a T-shaped structure comprising a ridge and a stem, the stem being coaxial with a longitudinal axis of the main body and being disposed between the ridge and the main body, the ridge having two opposite end sections which form clinching flaps, the flaps being bendable around said rail so as to secure the clip to the rail.

6. A clip according to claim 5, wherein the stem of the T-shaped structure has a concave shape.

7. A clip according to claim 1, wherein the main body has a longitudinal edge and the means for securing an insulator to said main body comprises a side member extending from the longitudinal edge of the main body, the side member comprising: a base section having an upper edge and a lower edge, two arms extending from opposite ends of the base section and having free ends and inner wall edges, one or more bendable tabs formed at the free ends of the arms, wherein the upper edge of the base section and the inner wall edges of the arms define a central cavity, the central cavity is disposed to receive an insulator, and the upper edge of the base section, the inner wall edges of the arms and the one or more bendable tabs are disposed to secure the insulator in said cavity.

8. A clip according to claim 7, wherein the upper edge of the base section is parallel to the bottom edge of the base section and to a longitudinal axis of the main body, further wherein the upper edge of the base section is perpendicular to the inner wall edges of the arms.

9. A clip according to claim 8, wherein the side member further comprises a neck section disposed between the longitudinal edge of the main body and the lower edge of the base section.

10. A clip according to claim 9, wherein the neck section is disposed at an angle relative to the main body.

11. A clip according to claim 9, wherein the clip comprises two of said side members.

12. A clip according to claim 1, wherein the main body comprises a longitudinal edge and the means for securing an insulator to said main body comprises a side member extending from said longitudinal edge of the main body, the side member comprising: a base section having an upper edge, an arm extending from an end of the base section and having a free end and inner and outer wall edges, and a bendable tab formed at the free end of the arm; wherein the upper edge of the base section, the inner wall edge of the arm and the longitudinal edge of the main body define a central cavity, the central cavity being disposed to receive an insulator, and the upper edge of the base section, the inner wall edge of the arm, the longitudinal edge of the main body, and the bendable tab being disposed to secure the insulator in said cavity.

13. A clip according to claim 12, wherein the upper edge of the base section is perpendicular to a longitudinal axis of the main body and to the inner and outer wall edges of the arm.

14. A clip according to claim 13, wherein the longitudinal edge of the main body further has formed therein an insulator-receiving tab disposed above the cavity.

15. A clip according to claim 14, wherein the clip comprises two of said side members.

16. A rail/clip assembly, comprising:

a rail;

an insulator; and a clip, secured to the insulator, includes at least one bendable clinching member, wherein said clip is securable to said rail by bending said bendable clinching member around said rail.

17. An assembly according to claim 16, wherein the rail has a T-shaped cross-section and comprises a ridge portion and a stem portion, further wherein said clip is securable to said rail by bending said bendable clinching member around the ridge portion of the rail.

18. An assembly according to claim 17, wherein the clip comprises two of the at least one bendable metal clinching member.

19. An assembly according to claim 18, wherein the bendable metal clinching members extend from opposite transverse edges of the main body.

20. An assembly according to claim 19, wherein each bendable metal clinching member has a T-shaped structure comprising a ridge and a stem, the stem being coaxial with a longitudinal axis of the main body and being disposed between the ridge and the main body, the ridge having two opposite end sections which form clinching flaps, the flaps being bendable around said rail so as to secure the clip to the rail.

21. An insulator comprising:

upper and lower longitudinal sides, each longitudinal side having a central groove and two side notches formed therein, the central groove being disposed between the side notches;

first and second transverse sides, each transverse side having an end groove formed therein; and front and back faces, each face having a transverse midsection disposed between the central grooves and being coaxial with a symmetrical transverse axis of the face; each face further having a longitudinal midsection disposed between the end grooves and being coaxial with a symmetrical longitudinal axis of the face, wherein the central groove is configured to engage a plurality of cross sectional structure shapes.

22. An insulator according to claim 21, wherein each central groove is a U-shaped structure having a bottom surface, an open top, and two inner wall surfaces.

23. An insulator according to claim 22, wherein each central groove has formed on each inner wall surface proximate to the open top thereof a semi-circular notch.

24. A rail/clip/insulator assembly, comprising:

a rail, at least one clip comprising a main body, a means for securing an insulator to said main body; and at least one bendable metal clinching member extending from the main body, wherein said clip is securable to said rail by bending said bendable clinching member around said rail; and an insulator attached to the means for securing an insulator to said main body.

25. An assembly according to claim 24, wherein the rail has a T-shaped cross-section and comprises a ridge portion and a stem portion, further wherein said clip is securable to said rail by bending said bendable clinching member around the ridge portion of the rail.

26. An assembly according to claim 25, wherein the clip comprises two of the at least one bendable metal clinching member.

27. An assembly according to claim 26, wherein the bendable metal clinching members extend from opposite transverse edges of the main body.

28. An assembly according to claim 27, wherein each bendable metal clinching member has a T-shaped structure comprising a ridge and a stem, the stem being coaxial with a longitudinal axis of the main body and being disposed between the ridge and the main body, the ridge having two opposite end sections which form clinching flaps, the flaps being bendable around said rail so as to secure the clip to the rail.

29. An assembly according to claim 28, wherein the main body has a longitudinal edge and the means for securing an insulator to said main body comprises a side member extending from the longitudinal edge of the main body; the side member comprising a base section having an upper edge and a lower edge; two arms extending from opposite ends of the base section and having free ends and inner wall edges; one or more bendable tabs formed at the free ends of the arms; the upper edge of the base section and the inner wall edges of the arms defining a central cavity, further wherein the insulator is disposed in the central cavity and secured therein by the upper edge of the base section, the inner wall edges of the arms and the one or more bendable tabs.

30. An assembly according to claim 29, wherein the insulator comprises:

upper and lower longitudinal sides, each longitudinal side having a central groove and two side notches formed therein, the central groove being disposed between the side notches;

first and second transverse sides, each transverse side having an end groove formed therein; and front and back faces, each face having a transverse midsection disposed between the central grooves and being coaxial with a symmetrical transverse axis of the face; each face further having a longitudinal midsection disposed between the end grooves and being coaxial with a symmetrical longitudinal axis of the face;

further wherein the insulator is disposed in the central cavity such that the transverse midsection of the front face of the insulator abuts the upper edge of the base section in parallel fashion, the arms of the clip are disposed within the central grooves of the insulator, and the bending tabs of the clip are disposed above the transverse midsection of the back face of the insulator.

31. An assembly according to claim 30, wherein each central groove is a U-shaped structure having a bottom surface, an open top, and two inner wall surfaces.

32. An assembly according to claim 31, wherein each central groove has formed on each inner wall surface proximate to the open top thereof a semicircular notch.

33. An assembly according to claim 28, wherein the main body comprises a longitudinal edge and the means for securing an insulator to said main body comprises a side member extending from said longitudinal edge of the main body; the side member comprising a base section having an upper edge, an arm extending from an end of the base section and having a free end and inner and outer wall edges, and a bendable tab formed at the free end of the arm; wherein the upper edge of the base section, the inner wall edge of the arm and the longitudinal edge of the main body define a central cavity, the central cavity being disposed to receive an insulator; and the upper edge of the base section, the inner wall edge of the arm, the longitudinal edge of the main body, and the bendable tab being disposed to secure the insulator in said cavity.

34. An assembly according to claim 33, wherein the insulator comprises:

upper and lower longitudinal sides, each longitudinal side having a central groove and two side notches formed therein, the central groove being disposed between the side notches;

first and second transverse sides, each transverse side having an end groove formed therein; and front and back faces, each face having a transverse midsection disposed between the central grooves and being coaxial with a symmetrical transverse axis of the face; each face further having a longitudinal midsection disposed between the end grooves and being coaxial with a symmetrical longitudinal axis of the face;

further wherein the insulator is disposed in the central cavity such that the transverse midsection of the front face of the insulator abuts the upper edge of the base section in parallel fashion, the arm of the clip and the longitudinal edge of the main body are disposed within the central grooves of the insulator, and the bending tab of the clip is disposed above the transverse midsection of the back face of the insulator.

35. An electric heater, comprising:

a terminal plate;

a cross-beam;

at least one rail, the rail being attached at one end to the terminal plate and at an opposite end to the cross-beam;

an insulator; and at least one clip secured to the at least one rail, the clip comprising a main body;

a means for securing the insulator to said main body; and at least one bendable metal clinching member extending from the main body, wherein said clip is securable to said rail by bending said bendable clinching member around said rail.

36. An electric heater according to claim 35, wherein the rail is butt-welded to the terminal plate.

37. An electric heater according to claim 35, wherein the rail has a T-shaped cross-section and comprises a ridge portion and a stem portion, further wherein said clip is securable to said rail by bending said bendable clinching member around the ridge portion of the rail.

38. An electric heater according to claim 37, wherein the clip comprises two of the at least one bendable metal clinching member.

39. An electric heater according to claim 38, wherein the bendable metal clinching members extend from opposite transverse edges of the main body.

40. An electric heater according to claim 39, wherein each bendable metal clinching member has a T-shaped structure comprising a ridge and a stem, the stem being coaxial with a longitudinal axis of the main body and being disposed between the ridge and the main body, the ridge having two opposite end sections which form clinching flaps, the flaps being bendable around said rail so as to secure the clip to the rail.

41. An electric heater according to claim 40, wherein the main body has a longitudinal edge and the means for securing an insulator to said main body comprises a side member extending from the longitudinal edge of the main body; the side member comprising a base section having an upper edge and a lower edge; two arms extending from opposite ends of the base section and having free ends and inner wall edges; one or more bendable tabs formed at the free ends of the arms; the upper edge of the base section and the inner wall edges of the arms defining a central cavity, further wherein the insulator is disposed in the central cavity and secured therein by the upper edge of the base section, the inner wall edges of the arms and the one or more bendable tabs.

42. An electric heater according to claim 41, wherein the insulator comprises:

upper and lower longitudinal sides, each longitudinal side having a central groove and two side notches formed therein, the central groove being disposed between the side notches;

first and second transverse sides, each transverse side having an end groove formed therein; and front and back faces, each face having a transverse midsection disposed between the central grooves and being coaxial with a symmetrical transverse axis of the face; each face further having a longitudinal midsection disposed between the end grooves and being coaxial with a symmetrical longitudinal axis of the face;

further wherein the insulator is disposed in the central cavity such that the transverse midsection of the front face of the insulator abuts the upper edge of the base section in parallel fashion, the arms of the clip are disposed within the central grooves of the insulator, and the bending tabs of the clip are disposed above the transverse midsection of the back face of the insulator.

43. An electric heater according to claim 42, wherein each central groove is a U-shaped structure having a bottom surface, an open top, and two inner wall surfaces.

44. An electric heater according to claim 43, wherein each central groove has formed on each inner wall surface proximate to the open top thereof a semicircular notch.

45. An electric heater according to claim 44, wherein the main body comprises a longitudinal edge and the means for securing an insulator to said main body comprises a side member extending from said longitudinal edge of the main body; the side member comprising a base section having an upper edge, an arm extending from an end of the base section and having a free end and inner and outer wall edges, and a bendable tab formed at the free end of the arm; wherein the upper edge of the base section, the inner wall edge of the arm and the longitudinal edge of the main body define a central cavity, the central cavity being disposed to receive an insulator; and the upper edge of the base section, the inner wall edge of the arm, the longitudinal edge of the main body, and the bendable tab being disposed to secure the insulator in said cavity.

46. An assembly according to claim 45, wherein the insulator comprises:

upper and lower longitudinal sides, each longitudinal side having a central groove and two side notches formed therein, the central groove being disposed between the side notches;

first and second transverse sides, each transverse side having an end groove formed therein; and front and back faces, each face having a transverse midsection disposed between the central grooves and being coaxial with a symmetrical transverse axis of the face; each face further having a longitudinal midsection disposed between the end grooves and being coaxial with a symmetrical longitudinal axis of the face;

further wherein the insulator is disposed in the central cavity such that the transverse midsection of the front face of the insulator abuts the upper edge of the base section in parallel fashion, the arm of the clip and the longitudinal edge of the main body are disposed within the central grooves of the insulator, and the bending tab of the clip is disposed above the transverse midsection of the back face of the insulator.

47. A method of securing an insulator to a rail, comprising the steps of:

(1) providing a rail, an insulator and a clip, wherein the clip comprises a means for securing an insulator to said main body and at least one bendable metal clinching member, (2) securing the clip to the rail by bending said bendable clinching member around said rail; and (3) securing the insulator to the means for securing an insulator to said main body, wherein step (3) may be performed before or after step (2).

48. A method according to claim 47, wherein the clip provided in step (1) comprises two of the at least one bendable metal clinching member.

49. A method according to claim 48, wherein, in the clip provided in step (1), the bendable metal clinching members extend from opposite transverse edges of the main body.

50. A method according to claim 49, wherein, in the clip provided in step (1), each bendable metal clinching member has a T-shaped structure comprising a ridge and a stem, the stem being coaxial with a longitudinal axis of the main body and being disposed between the ridge and the main body, the ridge having two opposite end sections which form clinching flaps; further wherein step (2) involves bending the flaps around said rail so as to secure the clip to the rail.

51. A method for making an electric heater, comprising the steps of:

(1) providing a terminal plate, a cross-beam, at least one rail, at least one clip and at least one insulator; wherein the clip comprises a main body; a means for securing an insulator to said main body; and at least one bendable metal clinching member extending from the main body;

(2) attaching a first end of the rail to the cross-beam and a second end of the rail to the terminal plate;

(3) securing the clip to the rail by bending said bendable clinching member around said rail; and (4) securing the insulator to the clip means for securing an insulator to the main body; wherein steps (2)–(4) may be performed in any order.

52. A method according to claim 51, wherein step (2) comprises butt-welding the second end of the rail to the terminal plate.

53. A method according to claim 51, wherein the clip provided in step (1) comprises two of the at least one bendable metal clinching member.

54. A method according to claim 53, wherein, in the clip provided in step (1), the bendable metal clinching members extend from opposite transverse edges of the main body.

55. A method according to claim 54, wherein, in the clip provided in step (1), each bendable metal clinching member has a T-shaped structure comprising a ridge and a stem, the stem being coaxial with a longitudinal axis of the main body and being disposed between the ridge and the main body, the ridge having two opposite end sections which form clinching flaps; further wherein step (3) involves bending the flaps around said rail so as to secure the clip to the rail.

* * * * *

UNITED STATES PATENT AND TRADEMARK OFFICE

CERTIFICATE OF CORRECTION

PATENT NO. : 6,509,554 B2 
DATED : January 21, 2003
INVENTOR(S) : Keith Howard, James Sherrill and Ike Walker It is certified that error appears in the above-identified patent and that said Letters Patent is hereby corrected as shown below:

Title page,
Item [56] References Cited
U.S. PATENT DOCUMENTS, insert:

| | | | | | |
|---|---|---|---|---|---|
| -- | 4,144,445 | 3/1979 | Thweatt, Jr. | 219/532 | |
| | 5,578,232 | 11/1996 | Engelke | 219/532 | |
| | 5,093,558 | 3/1992 | Blystone, et al. | 219/532 | |
| | 4,692,599 | 9/1987 | Howard, et al. | 219/532 | |
| | 5,954,983 | 9/1999 | Holmes | 219/536 | |
| | 4,472,624 | 9/1984 | Janning | 219/532 | -- |

Signed and Sealed this

Twentieth Day of May, 2003

JAMES E. ROGAN
*Director of the United States Patent and Trademark Office*